US005677702A

United States Patent [19]

Inoue et al.

[11] Patent Number: 5,677,702

[45] Date of Patent: Oct. 14, 1997

[54] DISPLAY UNIT INCORPORATING LIGHT GUIDING PLATE

[75] Inventors: Satohi Inoue; Makoto Tokunaga, both of Tokyo, Japan

[73] Assignee: Inoue Denki Co. Inc. Tokyo, Japan

[21] Appl. No.: 362,089

[22] Filed: Dec. 22, 1994

(Under 37 CFR 1.47)

[30] Foreign Application Priority Data

Dec. 27, 1993 [JP] Japan ..... 5-346954

[51] Int. Cl.[6] ..... G09G 3/34

[52] U.S. Cl. ..... 345/32; 359/42; 359/48; 359/49; 359/50; 362/32; 345/102

[58] Field of Search ..... 345/32, 102; 359/42, 359/48, 49, 50; 362/32

[56] References Cited

U.S. PATENT DOCUMENTS

| | | | |
|---|---|---|---|
| 5,070,431 | 12/1991 | Kitazawa et al. | 362/31 |
| 5,341,231 | 8/1994 | Yamamoto et al. | 359/49 |
| 5,442,374 | 8/1995 | Koizami | 345/110 |
| 5,467,208 | 11/1995 | Kokawa et al. | 359/49 |

FOREIGN PATENT DOCUMENTS

| | | | |
|---|---|---|---|
| 0144189 | 6/1979 | Germany | G09F 3/18 |
| 2929399 | 7/1979 | Germany . | |

*Primary Examiner*—Mark R. Powell
*Assistant Examiner*—Vincent E. Kovalick
*Attorney, Agent, or Firm*—Jordan and Hamburg

[57] ABSTRACT

A display unit incorporating a light guiding plate. The light guiding plate formed of a transparent plate has on at least a part of its reverse side a reflection surface made of a minutely uneven surface. Immediately behind the light guiding plate disposed is a viewing object display on which an object to be viewed is drawn. The viewing object display is at least partially drawn with a visible light conversion reflection material capable of reflecting invisible light such as ultraviolet light in the form of visible light. The portion drawn with the visible light conversion reflection material is positioned correspondingly behind the reflection surface of the light guiding plate. A light source for emitting invisible light and a light source for emitting visible light are provided. At least the invisible light emitting source is located on at least a part of one lateral edge of the light guiding plate. Thus, the object to be viewed drawn with the visible light conversion reflection material can be selectively viewed through the light guiding plate, by receiving some invisible light which has passed the reflection surface.

7 Claims, 5 Drawing Sheets

DISPLAY UNIT INCORPORATING LIGHT GUIDING PLATE

BACKGROUND OF THE INVENTION

1. Field of the Invention

The present invention relates generally to a display unit incorporating a light guiding plate, and more particularly to a display unit capable of varying portions of a viewing object viewable by naked eye by the use of invisible light such as ultraviolet light. The present invention is further directed to a display unit in which a grooved portion for the reflection of light is formed on at least a part of the reverse side of the light guiding plate, and in which immediately behind the reverse side of the light guiding plate there is disposed a viewing object display comprised of a film or plate member bearing thereon an object to be viewed such as letters or patterns, and in which at least a part of the viewing object display is drawn with a material capable of reflecting visible light in response to the irradiation of invisible light such as ultraviolet light, and in which at least some of light sources for the light guiding plate emit invisible light.

2. Description of the Related Arts

Known as a lighting means for, e.g., liquid crystal is a lighting means called light guiding plate. A typical light guiding plate is formed of a transparent plate of transparent plastics such as acrylic resin and nylonpolycarbonate or transparent materials including glass, and has on its one side a minutely uneven surface. Light sources are disposed on the lateral edge of the light guiding plate.

In this configuration, light originating from the light source strikes on the uneven surface provided on the reverse side of the light guiding plate, and then is reflected in the thickness direction of the light guiding plate. Most of the light is allowed to outgo from the front surface of the light guiding plate, and irradiates the liquid crystal lying on the surface of the light guiding plate, from the reverse side thereof. Thus, the light guiding plate functions as a back-light.

In the above light guiding plate, to ensure an effective function as a backlight, it is one of the significant technical problems to maximize the amount of light to be guided from the light source to the surface of the light guiding plate. However, a mere formation of the grooved portion will not ensure a reflection of the entire amount of light from the light source and will allow a part thereof to pass through the grooved portion to outgo from the reverse side of the light guiding plate. For this reason, some conventional backlight units may take measures to further place a reflection plate on the reverse side of the light guiding plate.

SUMMARY OF THE INVENTION

It is therefore an object of the present invention to provide a novel display unit by positively utilizing the above properties which have been hitherto pointed out as deficiencies of the light guiding plate.

More specifically, the object of the present invention is to provide a display unit in which a grooved portion for the reflection of light is formed on at least a part of the reverse side of the light guiding plate, and in which immediately behind the reverse side of the light guiding plate there is disposed a viewing object display comprised of a film or plate member bearing thereon an object to be viewed such as letters or patterns, and in which at least a part of the viewing object display is drawn with a material capable of reflecting visible light in response to the irradiation of invisible light such as ultraviolet light, and in which at least some of light sources for the light guiding plate emit invisible light.

The above configuration will ensure that a part of the invisible light being transmitted through the light guiding plate is allowed to pass through the reflection surface to outgo from the reverse side thereof, and that the light released from the reverse side will irradiate the object to be viewed disposed behind the light guiding plate and then will be reflected in the thickness direction of the light guiding plate. In this instance, if the object to be viewed is drawn with a material capable of reflecting invisible light as visible light, only that portion will be able to reflect visible light to be viewed, whereas leaving the other portion completely invisible since the invisible light is reflected as it is. Consequently, the visible object can be seen as if it is only floating against the darkness.

DESCRIPTION OF THE PREFERRED EMBODIMENTS

Exemplary embodiments of the present invention will now be described with reference to the accompanying drawings.

Figure 1:
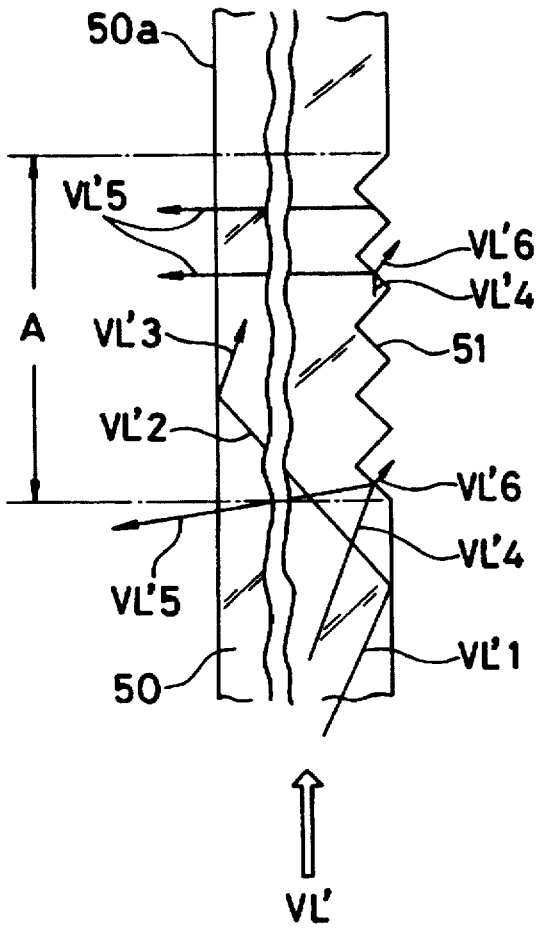
FIG. 1 is a fragmentary side elevational view of a light guiding plate for the explanation of a fundamental principle of the present invention.

Referring first to FIG. 1, description will be given of a principle on which the present invention is based. Light (visible light) VL' emitted from a light source disposed on one lateral edge of a light guiding plate 50 is reflected on a reflection surface defining thereon a multiplicity of grooves 51 formed on a reverse side of the light guiding plate 50, and leaves the light guiding plate 50 through a front surface 50*a* thereof to illuminate an object not shown. In this case, light VL' 1 reflected on the other regions than the groove forming surface partly leaks out through the reverse side of the light guiding plate 50, but is largely again reflected as reflected light VL' 2 on the front surface 50*a* side of the light guiding plate 50, resulting in reflected light VL' 3. In this manner, the reflected light VL' 3 is directed toward the other lateral edge of the light guiding plate 50 with the repeated reflection within the interior of the light guiding plate 50.

On the contrary, most of light VL' 4 which has reached the grooves 51 is allowed to outgo as reflected light VL' 5 from the front surface 50*a* of the light guiding plate 50. As a result of this, a region A of the front surface 50*a* of the light guiding plate 50 corresponding to the region where the grooves 51 are formed will exhibit a significant illuminance as compared with the other region thereof. However, a part of the light VL' 4 which has reached the grooves 51 will pass through the grooves 51 to outgo from the reverse side of the light guiding plate 50 as a leak-out light VL' 6 which will be an optical loss. For this reason, a variety of sectional configurations, depths, etc., of the grooves have been hitherto selected to minimize the leak-out light VL' 6. A display unit according to the present application is characterized by active utilization of the leak-out light leaving the light guiding plate through the reverse side thereof.

Figure 2:
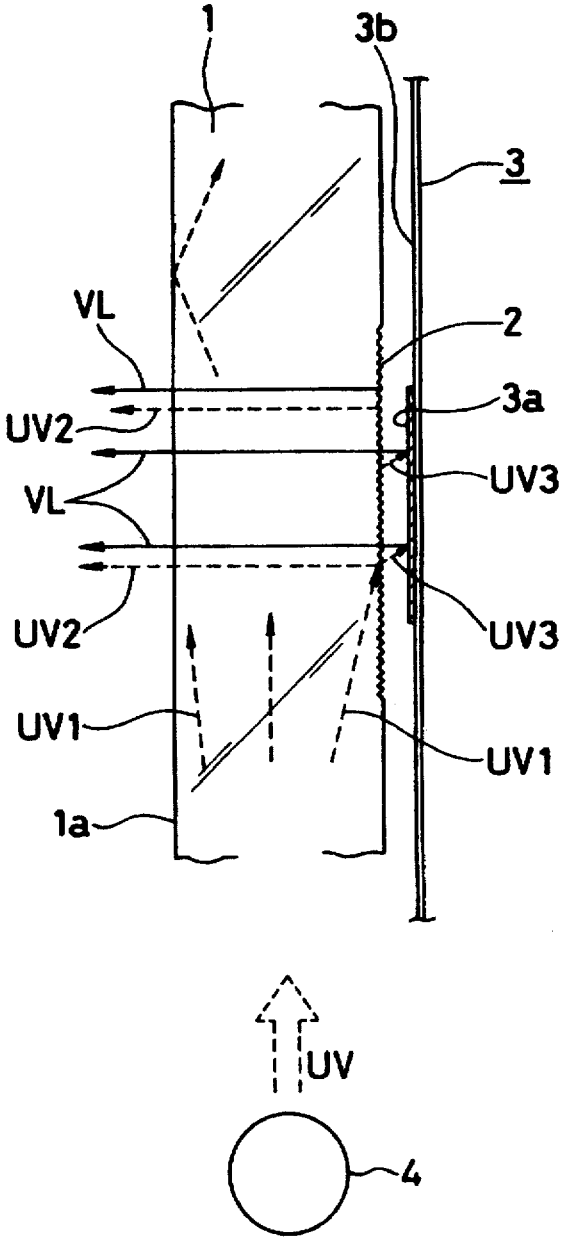
FIG. 2 is a fragmentary side elevational view of a light guiding plate according to a first embodiment, showing the state of reflection of ultraviolet light emitted from one lateral side of the light guiding plate.
Figure 3:
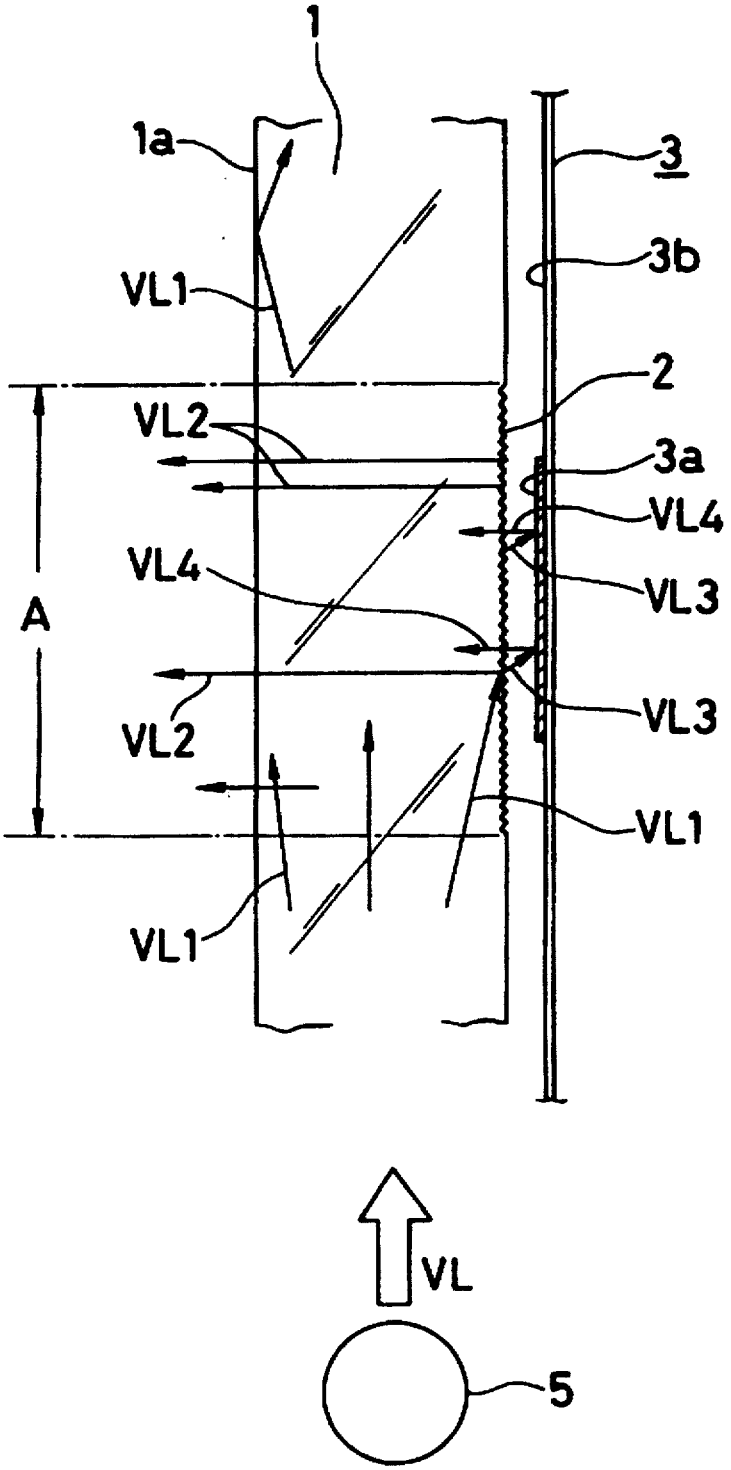
FIG. 3 is a fragmentary side elevational view of the same configuration as depicted in FIG. 2, showing the state of reflection of visible light emitted from one lateral side of the light guiding plate.
Figure 4:
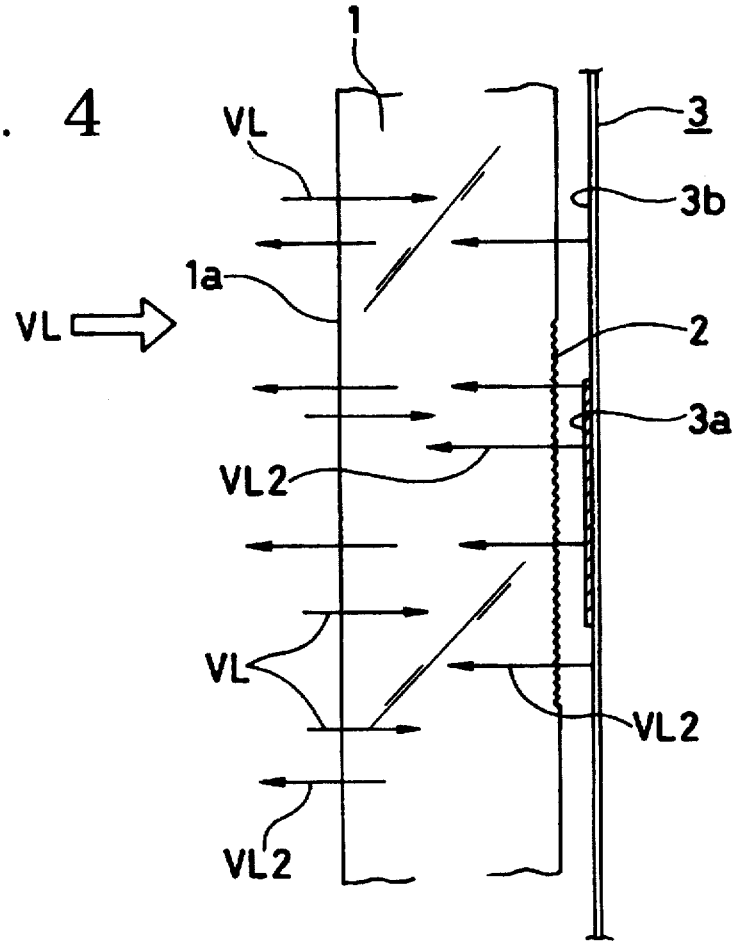
FIG. 4 is a fragmentary side elevational view of the same configuration as depicted in FIG. 2, showing the state of reflection of visible light emitted from the front of the light guiding plate.

Referring next to FIGS. 2 to 4, there is depicted a first embodiment of the present invention.

A light guiding plate designated at 1 is formed from a transparent material such as acrylic resin or glass in the same manner as the conventional light guiding plate. Formed on the reverse side of the light guiding plate 1 is a grooved portion 2 which may be naturally formed over the entire surface of the reverse side of the light guiding plate 1, but to ensure an enhanced display effect, should be formed on a part of the reverse side so as to correspond to the geometry of an object to be viewed which will be described later. The following description will be given of a case, by way of example, where the grooved portion is partly formed on the reverse side of the light guiding plate.

On the reverse side of the light guiding plate 1, arranged is a display panel 3 or a display to be viewed on which a visual recognition object is drawn. The display panel 3 or the display to be viewed serves to display predetermined diagrams or letters which may be direct visual recognition objects depending upon its applications. Although in the shown configuration the display panel 3 is slightly spaced apart from the reverse side of the light guiding plate 1, it may be in substantially familiar contact therewith.

Of the diagrams or letters drawn on the display panel 3, designated at 3*a* is a portion drawn with a paint, ink or pigment capable of converting irradiated ultraviolet light UV which is invisible light into visible light and reflecting the same (hereinafter these materials will be referred to generally as "visible light conversion reflection materials"). As shown, the portion 3*a* bearing the visible light conversion reflection materials on the display panel 3 is positioned immediately behind the groove 2 forming surface provided on the reverse side of the light guiding plate 1. It is to be naturally appreaciated that although the portion 3*a* drawn with the visible light conversion reflection material is shown protruding to be distinguished from the other display portion 3*b*, the actual display panel 2 has no steps between the portion 3*a* and the other portion 3*b*.

A light source 4 is disposed on the lateral edge of the light guiding plate 1 and serves to emit ultraviolet light UV which is invisible light. The light source for emitting ultraviolet light UV (hereinafter referred to as "ultraviolet light source") can be preferably an ultraviolet light emitting lamp commonly known as "black light".

The visible light conversion reflection materials to be applied on the display panel can be preferably a pigment containing zinc cadmium sulfide, zinc silicate, calcium silicate, etc. In the case of the pigment containing e.g., zinc cadmium sulfide, its content may be of the order of 0.85 which will allow the material to substantially completely respond only to ultraviolet light and upon the irradiation of ultraviolet light to reflect it in the form of visible light.

In the above configuration, when the ultraviolet light source 4 emits ultraviolet light UV in the substantial absence of visible light, for example, at night, reflection light reflected on the grooved portion 2, of the ultraviolet light UV1 advancing through the interior of the light guiding plate 1 is allowed to outgo as ultraviolet reflection light UV2 from the front surface 1*a* of the light guiding plate 1. Naturally, this reflection light UV2 remaining ultraviolet light is not to be visually recognized by the naked eye.

On the other hand, ultraviolet light UV3 which has passed through the grooved portion 2 and through the reverse side of the light guiding plate 1 will fall on the display panel 3 located on or in the vicinity of the reverse side of the light guiding plate 1. A part of the ultraviolet light UV3 will strike on the portion 3*a* drawn with the visible light reflection material to be reflected as visible light VL and then pass through the light guiding plate 1 to emerge from the front surface 1*a* thereof.

As a result of this, when the light guiding plate 1 is viewed from the front surface side (left side of the light guiding plate 1 in the figures) in, for example, darkness with the ultraviolet light source 4 of the unit energized to emit ultraviolet light UV, only the portion 3*a* drawn with the visible light conversion reflection material can be visually recognized but the other portion will remain darkness due to the exclusive emission of the ultraviolet light, so that the viewable portion looks as if it is floating in the darkness, resulting in a very fantastic display. Although depending on the pigments contained, most of the visible light reflected on the visible light conversion reflection material issues fluorescent light, which will contribute to the presentation of a more fantastic feeling.

FIG. 3 depicts a case where visible light is applied to the display unit thus configured.

Designated at 5 is a light source for emitting visible light VL (visible light source) such as a fluorescent lump disposed, for example, in the unit in conjunction with the ultraviolet light source 4. Upon the energization of the visible light source 5 to emit visible light VL, as shown in FIG. 1, most of visible light VL1 being transmitted through the interior of the light guiding plate 1 is reflected on the grooved portion 2, resulting in output light VL2. The other portion than the grooved portion will cause the visible light VL to reflect within the interior of the light guiding plate 1, with the result that very little light is allowed to leave the light guiding plate 1 through the front surface 1*a* thereof. Consequently, in the front surface 1*a* of the light guiding plate 1, only a portion corresponding to the grooves 2 provided on the reverse side will glow brightly correspondingly to the planar geometry of the groove forming surface. It should be appreciated that a part of visible light VL1 is transmitted through the grooved portion 2 to give forth visible light VL3 from the reverse side of the light guiding plate 1 as described hereinabove, but that the amount of light VL4 arising from the visible light VL3 reflected on the display panel and outgoing from the front surface of the light guiding plate is much lesser than that of the reflected light VL2 reflected on the grooved portion 2, whereupon the display of the display panel is hardly to be seen from the side of the light guiding plate front surface, irrespective of whether it is the portion 3a drawn with the visible light conversion reflection material or the other portion, thus allowing a bright glow of only the portion of the light guiding plate front surface corresponding to the geometry of the grooves 2 provided on the reverse side of the light guiding plate 1.

FIG. 4 depicts a viewing state when visible light impinges on the front surface of the light guiding plate 1 incorporated in the unit shown in FIGS. 2 and 3.

In the case where visible light VL is striking on the front surface of the light guiding plate 1, for example, during the daylight, the visible light VL is permitted to pass through the light guiding plate 1 in the thickness direction and through the reverse side thereof to reach the display panel 3. Visible light VL2 reflected on the display panel 3 is again transmitted through the light guiding plate 1 to outgo from the front surface 1a thereof. As s result of this, during the daylight, all that is displayed on the display panel 3 can be viewed by way of the transparent light guiding plate 1, regardless of whether it is the portion 3a drawn with the visible light conversion reflection material or the other portion. In this case, when the display panel 3 located on the reverse side is viewed by way of the grooved portion 2, a viewing image may possibly be offset or become unclear due to unevenness of the grooves 2 formed on the reverse side of the light guiding plate 1. For this reason, the present inventors have prepared a plurality of light guiding plates each having a grooved portion different in depth, and respective viewing conditions were experimentally observed by the naked eye.

From the above experiments, it has been turned out that the viewing of the display panel 3 is substantially the same as the flat portion free of grooves as long as the depth of the grooves lies within the range of about 0.05 mm to 0.3 mm, preferably about 0.10 mm to 0.15 mm. The grooves were each triangular in sectional contour and interconnected with no flat portion between the adjacent grooves. It has also turned out that a groove depth of 0.05 mm or less would improve the visibility but impractically cause a reduction in the reflection amount of light irradiated from the lateral edge of the light guiding plate as well as a difficulty in forming the grooves. Although use was made of grooves having triangular sectional contours in this experiment, other contours such as substantially a semicircular shape than the triangles will result in substantially the same effects.

FIGS. 5 and 6 depict, by way of concrete examples, viewing states of the display panel subjected to the various rays of light described above.

Figure 5A:
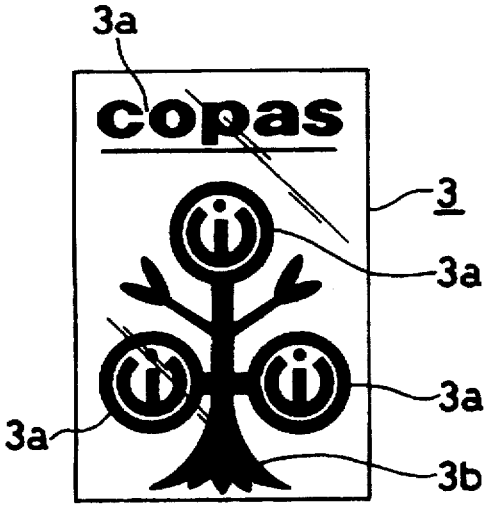
FIG. 5A is a front elevational view of a display panel showing, by way of example, a display condition thereof.

Referring to FIG. 5A, the display panel 3 disposed behind the light guiding plate 1 is shown bearing thereon graphic patterns and letters to serve as a sign representing a company. On the panel 3, a company name "COPAS" and three company symbols are drawn with a visible light conversion reflection material 3a capable of reflecting ultraviolet rays as a visible light. A tree-like display interlinking the three company symbols is comprised of an ordinary display portion 3b drawn with an ordinary ink or pigment. The background of the display panel 3 may be, for example, yellow.

Figure 5B:
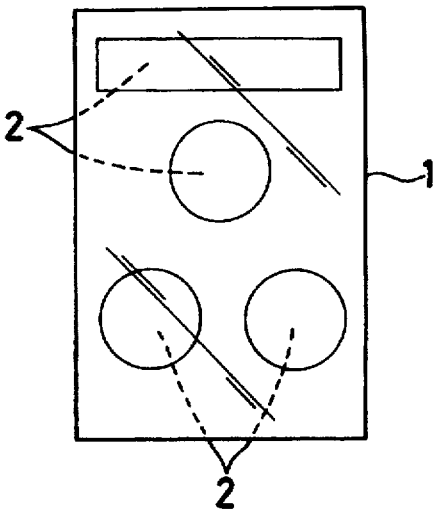
FIG. 5B is a top plan view of a light guiding plate corresponding to the display panel.

Referring to FIG. 5B, the light guiding plate 1 associated with the display panel 3 is shown having grooves 2 formed on the reverse side thereof so as to correspond to the portion 3a drawn with the visible light conversion reflection material 3a. The light guiding plate 1 is disposed immediately in front of the display panel 3 and includes an ultraviolet light source 4 and a visible light source 5 provided on its upper edge or lower and upper edges, respectively. Under such condition, when visible light is falling on the front surface 1a of the light guiding plate 1, for example, during the daylight, the visible light is permitted to pass through the light guiding plate 1, whereupon all the displays on the display panel 3 arranged just behind the light guiding plate 1 can be viewed as shown in FIG. 5A.

Figure 6A:
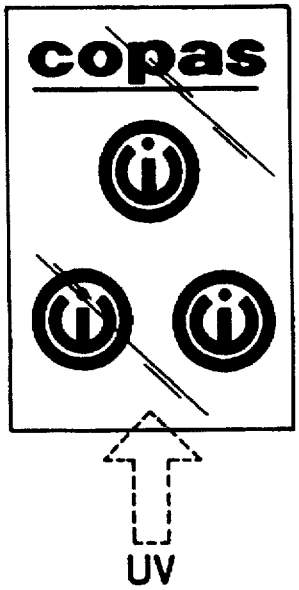
FIG. 6A illustrates a state of the display panel which will be viewed through the light guiding plate when ultraviolet light is emitted via the light guiding plate.

Referring to FIG. 6A, depicted is a viewing state when ultraviolet light UV is emitted in this unit, with little or no visible light striking on the front surface of the light guiding plate 1, for example, at night. In this case, the company name and three company symbols constituting the display portion 3a drawn on the display panel 3 with the visible light conversion reflection material will reflect the ultraviolet light UL as visible light VL for illuminating display, leaving the other portion than the display portion 3a completely invisible and dark. For this reason, the display at night will be significantly different from the display in the daylight where all the letters and patters can be seen with yellow background, and will present a fairly fantastic display.

Figure 6B:
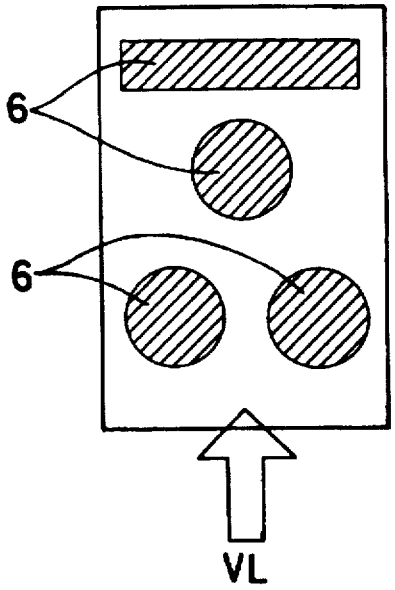
FIG. 6B illustrates a state of the light guiding plate which will be viewed when visible light is emitted through the light guiding plate.

Referring to FIG. 6B, depicted is a viewing state when emitting visible light VL from the visible light source in place of the ultraviolet light UV. In this case, a high luminance areas 6 will appear correspondingly to the configuration of the grooves 2 since the visible light VL is permitted to be so reflected as to correspond to the groove forming portion, resulting in a different display from that upon the emission of ultraviolet light. A switch from ultraviolet light UV to visible light VL may be instantaneously effected. Alternatively, for example, the amount of light of the ultraviolet light UV may be gradually decreased accordingly as the amount of ultraviolet light UV is gradually increased, whereby the display portion drawn with the visible light conversion reflection material shown in FIG. 6A will be gradually brightened with the company name and company symbol disappearing into the brightness. The opposite operation to this would allow the company symbols and name to appear against the high luminance areas 6 accordingly as the luminance of the high luminance areas 6 is decreased, resulting in an extremely fantastic display. During these operations, the front surface of the light guiding plate 1 may be irradiated with visible light so that all of the panel displays shown in FIG. 5A can be seen.

Figure 7:
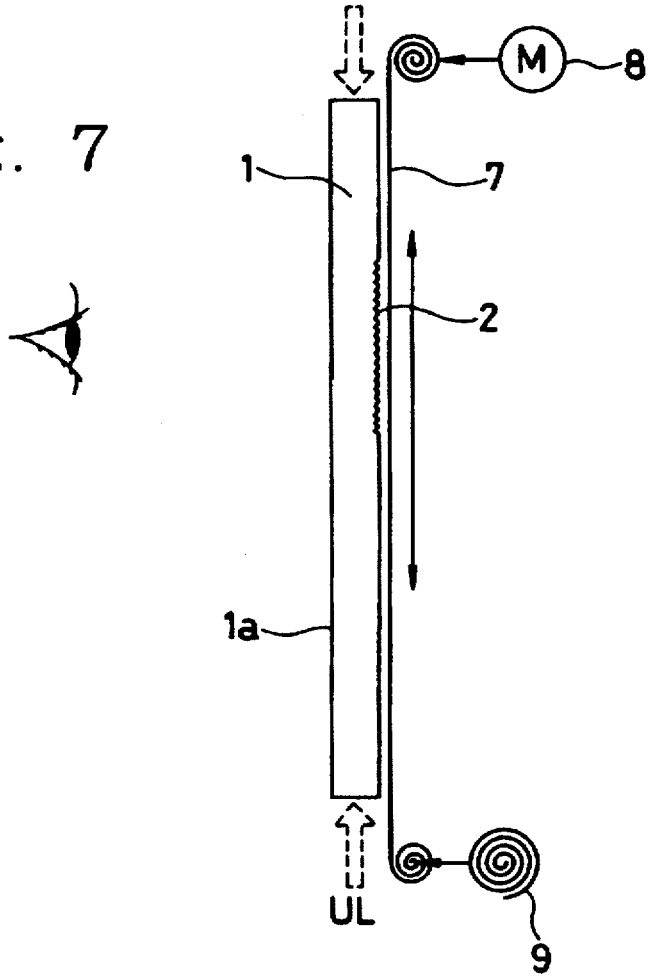
FIG. 7 is a side elevational view of a display unit according to a second embodiment of the present invention.

FIG. 7 depicts another embodiment of the present invention. In this embodiment, an object to be viewed is in the form of a film. Designated at 7 is a display film partially bearing a visible light conversion reflection material in the same manner as the display panel 3. A motor 7 is provided to wind the display film 7. Confronting the motor 7 and engaged with the film end is a spiral spring 9 serving to produce a drive force for rewinding the film wound by the motor 8.

In this unit, the motor 8 can be appropriately driven or stopped to move the display film 7 so as to change graphic patterns to be viewed through the light guiding plate 1. It will be appreciated that means for moving the display film is not be limited to the shown combination of the motor 8 and the spiral spring 9. It is naturally possible to appropriately combine ultraviolet light UV and visible light VL as in the case of FIGS. 5 and 6.

Figure 8:
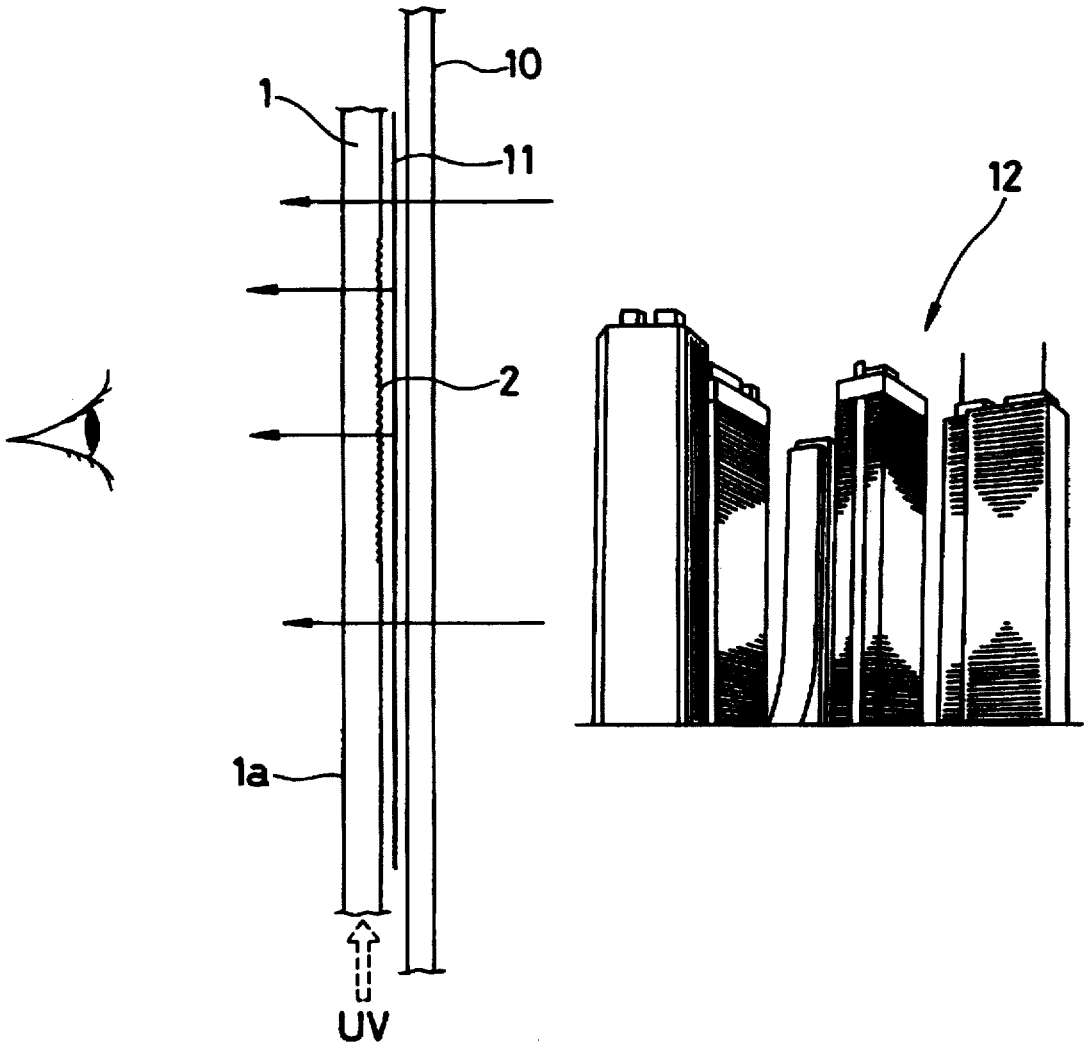
FIG. 8 is a side elevational view of a display unit according to a third embodiment of the present invention being disposed in close proximity to a window pane.

FIG. 8 depicts still another embodiment of the present invention. This unit is disposed in close proximity to a transparent window pane 10 for buildings. A transparent film 11 corresponds to the display film described above and bears thereon a variety of displays drawn with a visible light conversion reflection material. In this unit, the displays drawn on the transparent film 11 can be viewed upon emitting ultraviolet light UV within a darkened room. In this case, the other portions than the display portions drawn with the visible light conversion reflection material will permit an exclusive emission of ultraviolet light, and hence the external scene 12 can be seen as it stands through the light guiding plate 1, transparent film 11, and then window pane 10, whereupon only the display portions drawn with the visible light conversion reflection material can be displayed as if they are floating against the scene 12.

If it is desired to cause any patterns to float against the scene, the unit may be loaded with a transparent film 11 bearing desired messages or patterns drawn with the visible light conversion reflection material.

Although ultraviolet light is used as an invisible light in the above description of the unit according to the present invention, X-ray or other rays of light are also available. It is also possible to use materials capable of reflecting long-wavelength invisible light, that is, infrared rays to emit visible light, such as for example a photoluminescent material as an inorganic pigment. It is to be noted in this case that a heat releasing means is preferably provided in order to release heat generated by the infrared rays.

In the present invention as described above, a display to be viewed bearing viewing objects is disposed immediately behind the light guiding plate. Further, a positive utilization is made of light which has leaked out partially from the reverse side of the grooved portion and which has been hitherto pointed out as a problem. Also, at least one of rays of light striking on the light guiding plate is invisible light. Further, at least a part of the object to be viewed is drawn by use of materials capable of reflecting invisible light in the form of visible light. By virtue of the above features, an appropriate selection of light to be radiated through the light guiding plate would ensure a selective viewing of the object to be viewed drawn on the viewing object display and would create a strong impression on the viewers as a variety of display means including advertisement.

What is claimed is:

1. A display unit incorporating a light guiding plate, comprising:

a light guiding plate formed of a transparent plate having a reflection surface, said reflection surface made of a minutely uneven surface provided on at least a part of the reverse side of said light guiding plate;

a viewing object display bearing an object to be viewed drawn thereon, said viewing object display disposed immediately behind said light guiding plate, at least a part of said object to be viewed being drawn with a visible light conversion reflection material capable of reflecting invisible light in the form of visible light, the portion drawn with said visible light conversion reflection material being positioned behind said reflection surface of said light guiding plate; and a couple of light sources for emitting invisible light and visible light, respectively, at least said invisible light emitting source of said two sources being arranged on at least a part of one lateral edge of said light guiding plate, said object to be viewed drawn with said visible light conversion reflection material capable of being selectively viewed through said light guiding plate by receiving some invisible light which has passed through said reflection surface.

2. A display unit incorporating a light guiding plate according to claim 1, wherein said invisible light is ultraviolet light, and wherein said light source for emitting invisible light is a ultraviolet light source.

3. A display unit incorporating a light guiding plate according to claim 1, wherein said reflection surface provided on the reverse side of said light guiding plate is comprised of contiguous grooves having substantially triangular contours in section.

4. A display unit incorporating a light guiding plate according to claim 3, wherein said triangular grooves have a depth of the order of 0.10 mm to 0.15 mm.

5. A display unit incorporating a light guiding plate according to claim 1, wherein said viewing object display disposed immediately behind said light guiding plate is a windable film.

6. A display unit incorporating a light guiding plate according to claim 1, wherein said viewing object display disposed immediately behind said light guiding plate is transparent, and wherein the background except the portion bearing an object to be viewed drawn thereon is capable of being viewed through said light guiding plate and said viewing object display.

7. A display unit incorporating a light guiding plate according to claim 6, wherein said light guiding plate and said viewing object display are arranged in close proximity to a window pane.

* * * * *